US005540501A

United States Patent [19]

Franco

[11] Patent Number: 5,540,501

[45] Date of Patent: Jul. 30, 1996

[54] LAUNDRY BAG ASSEMBLY

[75] Inventor: Jack Franco, Deal, N.J.

[73] Assignee: Franco Manufacturing Company, Inc., Metuchen, N.J.

[21] Appl. No.: 531,790

[22] Filed: Sep. 21, 1995

[51] Int. Cl.[6] ..... B65D 33/14

[52] U.S. Cl. ..... 383/13; D32/36; 206/287; 383/24; 383/28; 383/907

[58] Field of Search ..... 383/13, 24, 28, 383/907, 66, 22, 23; 206/286, 287; D32/36

[56] References Cited

U.S. PATENT DOCUMENTS

| | | | |
|---|---|---|---|
| D. 50,469 | 3/1917 | Eisemann . | |
| D. 76,384 | 9/1928 | Ferguson . | |
| D. 91,135 | 12/1933 | Gilligan | 383/24 |
| D. 152,173 | 12/1948 | Seidler . | |
| D. 179,866 | 3/1957 | Sork . | |
| 821,986 | 5/1906 | Coburn | 383/24 |
| 1,564,930 | 12/1925 | Boyes . | |
| 1,611,877 | 12/1926 | Blang | 383/24 |
| 2,815,785 | 12/1957 | Vail | 383/13 |
| 3,099,568 | 7/1963 | Brody et al. | 383/28 |
| 4,694,503 | 9/1987 | Hydorn | 383/24 |
| 5,118,201 | 6/1992 | Cook | 383/12 |

*Primary Examiner*—Stephen P. Garbe
*Attorney, Agent, or Firm*—Steinberg, Raskin & Davidson, P.C.

[57] ABSTRACT

A laundry bag assembly for children including a bag into which articles are insertable having a first side and a second side and a hanger part for suspending the bag. An upper peripheral region defines an aperture having a neck opening portion and a first arm opening portion on the first side of the bag. First and second connecting areas are situated on the peripheral region and a second arm opening is situated on the second side of the bag. The hanger part has a head portion, a neck portion situated at the lower part of the head portion and first and second arm portions extend laterally from the neck portion. The second arm portion is removably insertable into the second arm opening of the bag. The bag includes cooperating fastening members for attaching the first connector area of the upper peripheral region to the second connector area of the upper peripheral region to thereby separate the bag aperture into a first arm opening and a neck opening. The first arm portion of the hanger part is removably insertable through the first arm opening and the neck portion of the hanger part is removably insertable through the neck opening to thereby secure the bag and the hanger part.

18 Claims, 3 Drawing Sheets

LAUNDRY BAG ASSEMBLY

FIELD OF THE INVENTION

The present invention relates generally to laundry bags and, more particularly, to laundry bag assemblies for children.

BACKGROUND OF THE INVENTION

Although children are taught at an early age to deposit their dirty clothes in hampers or laundry bags, it is a well known fact that these instructions are not often heeded. Thus, conventional laundry or hamper bags which generally include a plain fabric bag provided with a draw string for the closing of the top of the bag and for suspending the bag from a hook or the like, do nothing to induce or entice children to use them.

Laundry bag assemblies designed for children's use have been constructed in the shape of characters, such clowns or animals, to make the act of depositing dirty clothes into the laundry bag more of a playful activity for children than a chore.

For example, a garment bag designed for children is disclosed in U.S. Pat. No. 76,384. The device includes an upper member defining a head and upper torso which appears to be flat and a lower bag suspended from the upper member defining a lower body or skirt. The bag is provided with slits in the side, apparently for the insertion of dirty clothes. It remains, however, that the manner of suspending the bag from the upper member, which appears to include stretching of an elastic band, defining the waistband of the skirt, around the flat upper torso member, is unreliable in that a child could pull the bag from the upper member by merely tugging at its lower portion and stretching the elastic band. In addition, the elastic band may become stretched out of its original shape, further diminishing the reliability of the suspension mechanism. A further problem with this assembly exists in that the removal of clothes from the bag appears to be a difficult process. Neither the size of the slits in the side of the bag nor the opening in the bag top appear to be sufficient for easy removal of dirty clothes from the bag.

OBJECTS AND SUMMARY OF THE INVENTION

It is an object of the present invention to provide a new and improved laundry or hamper bag assembly.

It is another object of the present invention to provide a new and improved laundry or hamper bag assembly especially designed for children.

It is still another object of the present invention to provide a laundry or hamper bag assembly for children comprising a two part assembly in which a bag is reliably suspended from a hanger part.

It is yet another object of the present invention to provide a laundry or hamper bag assembly for children which provides both easy introduction of clothing into the bag as well as easy removal of the clothing out of a large aperture located at the upper peripheral region of the bag.

In view of achieving these objects, and others, in the device of the present invention, a hanger part is combined with a separable bag which defines a lower body of a fanciful character. The bag, preferably formed from cloth, has a first side, a second side, an upper peripheral region and a second arm opening on the second side of the bag. The upper peripheral region defines an aperture which has a neck opening portion and a first arm opening portion on the first side of the bag. The bag further comprises cooperating fastening means, e.g. a set a hooks and loops or snaps, for attaching a first connector area of the peripheral region to a second connector area thereof. When the connector areas are attached, the bag aperture is separated into a first arm opening and a neck opening. The hanger part comprises a plush or soft sculpture having portions defining a head, a neck situated at the lower part of the head, and first and second arms extending laterally from the neck.

To secure the bag to the hanger part, the second arm portion of the hanger part is inserted through the second arm opening of the bag. The first arm portion is then positioned within the first arm opening portion of the upper peripheral region of the bag aperture. The connector areas are then attached thus forming the first arm opening and the neck opening whereby the first arm portion and the neck portion of the hanger part are secured within the newly formed first arm opening and the neck opening.

In a preferred embodiment, a non-elastic strap, preferably formed from heavy cloth, is affixed along the neck opening portion of the upper peripheral region of the bag aperture. The above-mentioned cooperating fastening means are located on the ends of the strap for attaching a first end of the strap to a second end of the strap thus dividing the bag aperture into the first arm opening and the neck opening. The non-elastic strap encircles the neck portion of the hanger part to securely fasten the bag thereto. In addition, hanging means, e.g. a loop, is situated on the head portion of the hanger part for hanging the laundry bag assembly.

It is an important and remarkable advantage of the present invention over the prior art devices that, according to the invention, in removing the bag from the hanger part, the fastening means are disconnected whereby the neck opening and the first arm opening are combined to form one contiguous opening. This large opening enables the bag part to be removed from the hanger part and facilitates the easy removal of the dirty clothes which have been deposited into the laundry bag. Moreover, this construction provides a reliable connection of the bag to the hanger part to eliminate any possibility that a child will inadvertently pull the bag away from the hanger part.

BRIEF DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
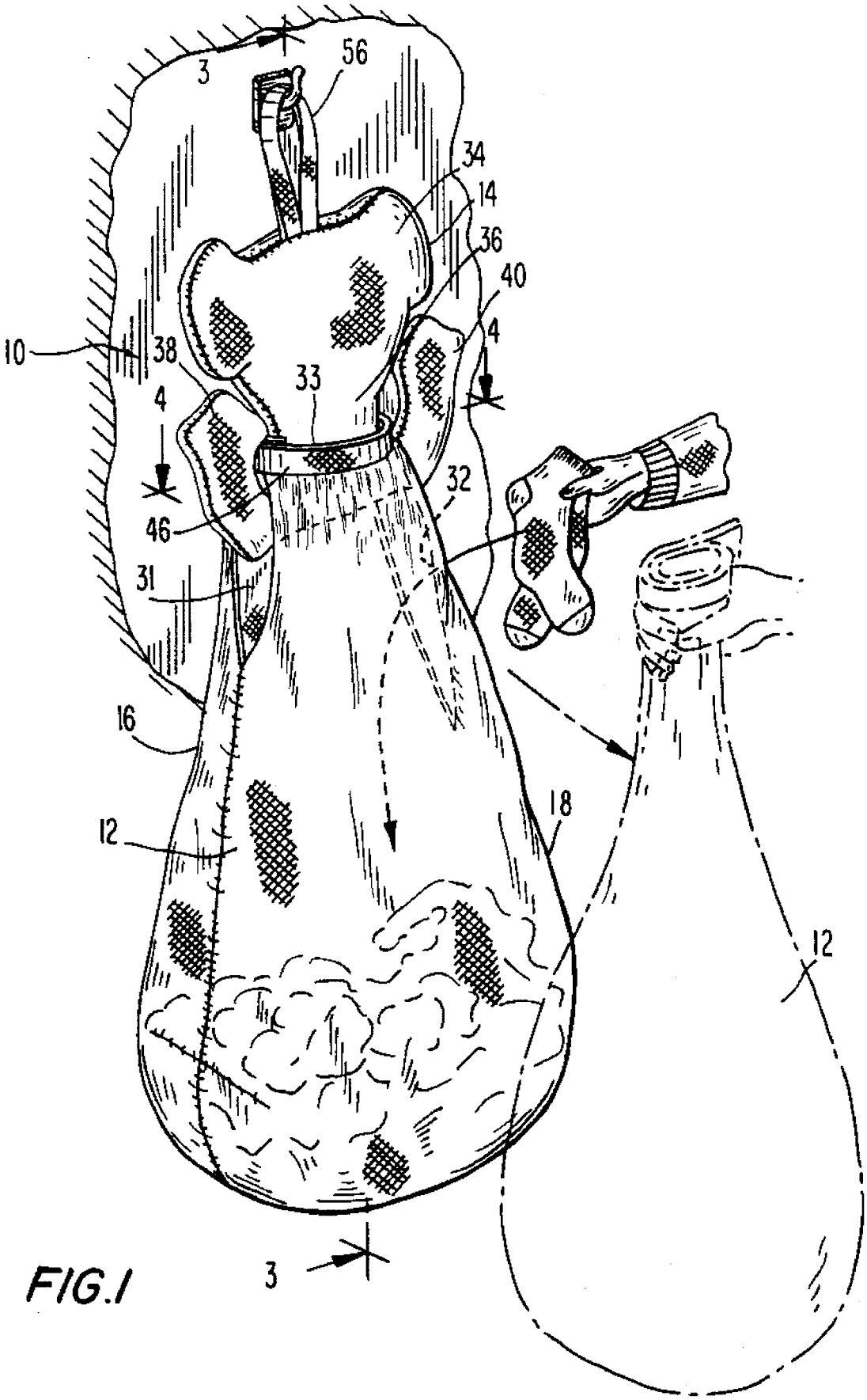
FIG. 1 is a perspective view of a laundry or hamper bag assembly in accordance with the invention in use showing the insertion of items into the laundry bag assembly, with the bag member of the laundry bag assembly when removed from the hanger part of the laundry bag assembly shown in phantom.

Referring now to the drawings wherein like reference characters designate identical or corresponding parts throughout the several views, and more particularly to FIGS. 1–4, a laundry bag assembly 10 comprises a bag 12 and a hanger part 14. The bag 12, preferably formed from cloth and into which articles are insertable, has a first arm opening 31 and a second arm opening 32 located on the first side 16 and the second side 18 of the bag 12 respectively. The bag further includes a neck opening 33 located on the upper part of the bag.

The hanger part 14, on which the bag 12 is suspended, comprises a plush or soft sculpture having a head portion 34, a neck portion 36, and first and second arm portions 38, 40 which extend laterally from the neck portion 36. The first and second arm portions 38, 40 are removably insertable into the first and second arm openings 31,32 of the bag respectively as described below to form the assembly.

Figure 4:
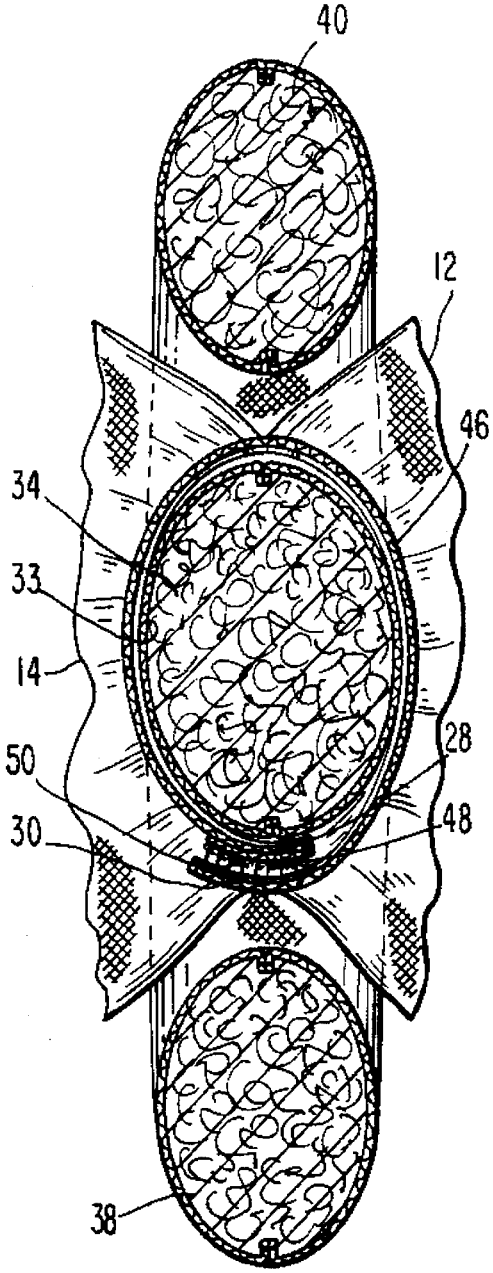
FIG. 4 is a sectional view taken along the line 4—4 in FIG. 1.

Referring to FIG. 4, a non-elastic strap 46 formed from heavy cloth is situated around the neck opening 33 of the bag 12. The strap includes a first connecting area 28 located on one end of the strap 46 and a second connecting area 30 located on the other end of the strap 46 for connecting the two ends of the strap 46. In the preferred embodiment of the invention, the connecting areas comprise VELCRO® strips such that hooks 48 are located on the first connecting area 28 and loops 50 are located on the second connecting area 30. The connecting areas 28,30 comprise cooperating fastening means for connecting the two ends of the strap 46.

Figure 2:
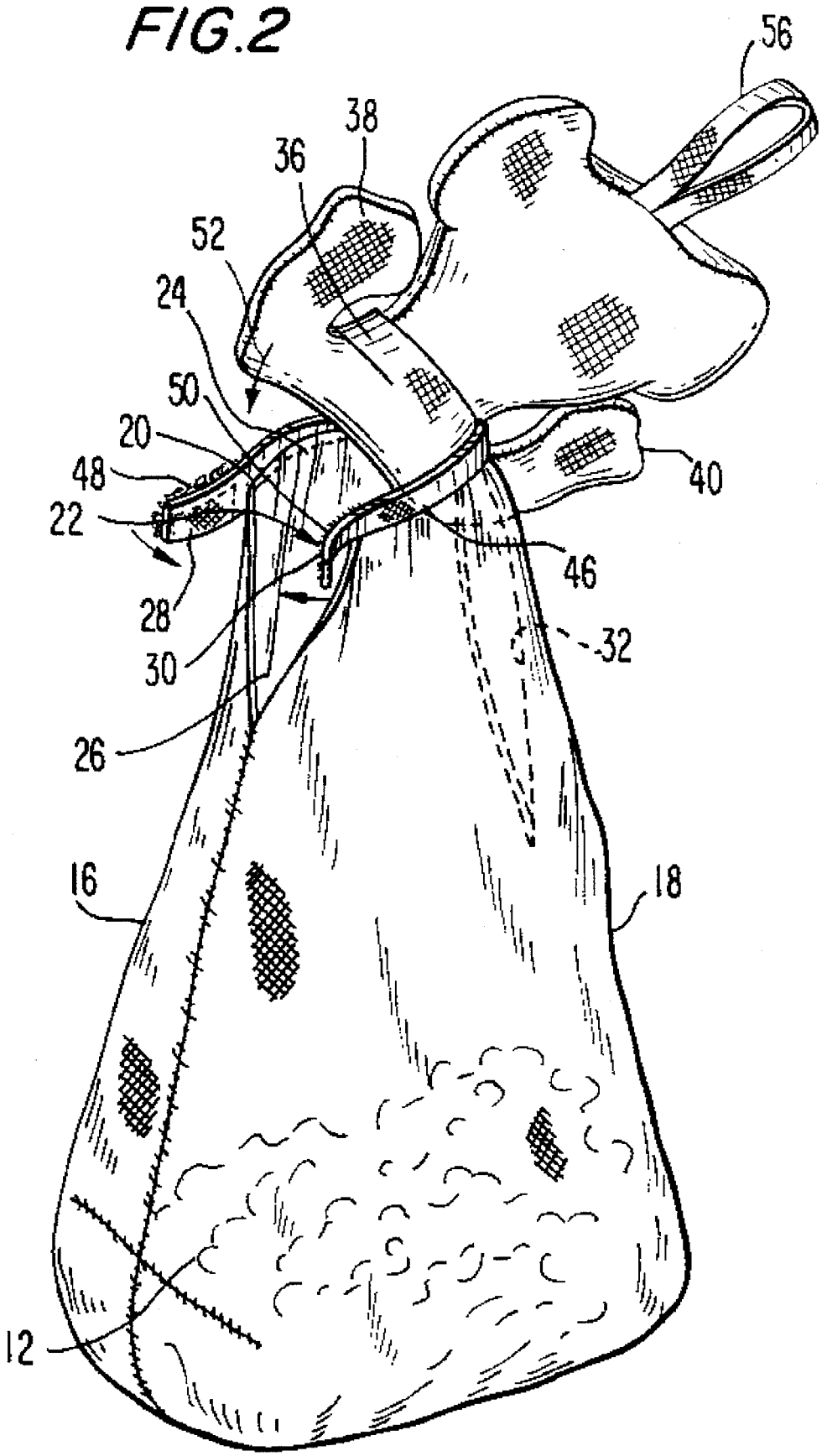
FIG. 2 is a perspective view of a laundry bag assembly in accordance with the invention showing the assembly of the hanger part to the bag.
Figure 3:
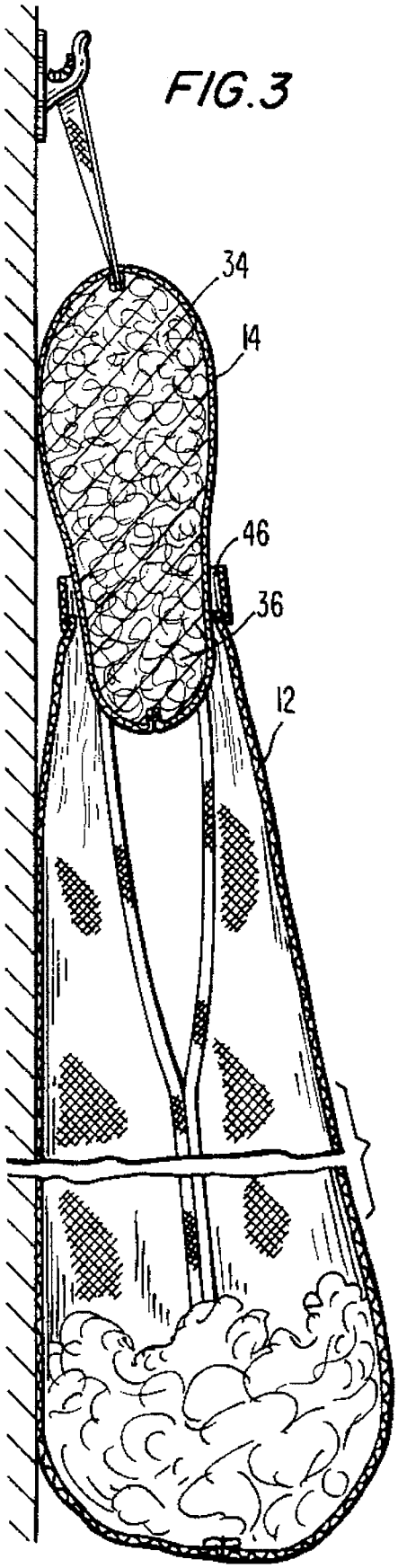
FIG. 3 is a sectional view taken along the line 3—3 in FIG. 1.

Referring to FIG. 2, which shows the bag 12 separated from the hanger part 14, an upper peripheral region 20 defines a large open aperture 22. The aperture 22 has a neck opening portion 24 and a first arm opening portion 26 on the first side 16 of the bag 12. The strap 46 is affixed around the neck opening portion 24 of the aperture 22 wherein the ends of the strap 46 comprise cooperating fastening means which are designed to attach the first connector area 28 situated on one end of the strap 46 to the second connector area 30 situated on the other end of the strap 46 to thereby divide the bag aperture 22 into the first arm opening 31 and the neck opening 33.

In attaching the bag 12 and the hanger part 14, the second arm portion 40 of the hanger part 14 is inserted through the second arm opening 32 of the bag 12 as seen in FIG. 2. The first arm portion 38 is moved in the direction of arrow 52 into the first arm opening portion 26 of the upper peripheral region 20 of the bag aperture 22. The connector areas 28,30 are then attached thus forming the first arm opening 31 and the neck opening 33 whereby the first arm portion 38 and the neck portion 36 of the hanger part 14 are secured within the newly formed first arm opening 31 and the neck opening 33.

Thus, the cooperating fastening means have a closed position as shown in FIG. 1 in which the first arm opening 31 and the neck opening 33 are divided and wherein the hanger part 14 is connected to the bag 12, and an open position as shown in FIG. 2 in which the first arm opening 31 and the neck opening 33 (only shown in FIG. 1) are a contiguous aperture 22 and wherein the hanger part 14 is removable from the bag 12.

In the preferred embodiment, the hamper assembly further comprises hanging means 56, e.g. a loop, situated at the upper portion of the head of the hanger part. The hanging means enable the hamper assembly to be suspended from a hook or the like. Furthermore, the hamper assembly constitutes an animal or the like wherein the hanger part 14 comprises a stuffed toy-like member and the bag 12 comprises the body portion.

An assembly as disclosed provides the user with a laundry bag designed for children in which a bag is reliably suspended from a hanger part. The possibility of the bag being easily removed from the hanger by a child is greatly diminished as compared to such a possibility as is present with prior laundry bag assemblies. Moreover, the laundry bag assembly as disclosed provides the user with a bag whose contents are easily removable.

Obviously, numerous modifications and variations of the present invention are possible in light of the above teachings. For example, snaps or buttons may be used as the cooperating fastening means and the strap may be formed from plastic. Moreover, the strap 46 may be eliminated and the first and second connecting areas 28,30 may be situated directly on the peripheral region 20. It is therefore to be understood that within the scope of the claims appended hereto, the invention may be practiced otherwise than as specifically disclosed herein.

I claim:

1. A laundry bag assembly, comprising:

a bag into which articles are insertable having a first side, a second side, an upper peripheral region defining an aperture having a neck opening portion and a first arm opening portion on said first side of said bag, first and second connecting areas situated on said peripheral region, and said bag further having a second arm opening on said second side of said bag;

a hanger part for suspending said bag and comprising a head portion, a neck portion situated at the lower part of said head portion and first and second arm portions extending laterally from said neck portion, wherein said second arm portion is removably insertable into said second arm opening of said bag; and cooperating fastening means for attaching said first connector area of said upper peripheral region to said second connector area of said upper peripheral region to thereby separate said bag aperture into a first arm opening and a neck opening, wherein said first arm portion of said hanger part is removably insertable through said first arm opening and said neck portion of said hanger part is removably insertable through said neck opening to thereby secure said bag and said hanger part.

2. A laundry bag assembly as recited in claim 1, further comprising a non-elastic strap having a first and second end, said non-elastic strap surrounding said neck opening portion of said aperture, wherein said cooperating fastening means are situated on the ends of said non-elastic strap for attaching said first end of said non-elastic strap to said second end of said non-elastic strap to divide said bag aperture into said first arm opening and said neck opening.

3. A laundry bag assembly as recited in claim 1, wherein said fastening means comprise hooks located on said first connector area of said upper peripheral region and loops located on said second connector area of said upper peripheral region.

4. A laundry bag assembly as recited in claim 2, wherein said fastening means comprise hooks located on said first end of said non-elastic strap and loops located on said second end of said non-elastic strap.

5. A laundry bag assembly as recited in claim 2, wherein said non-elastic strap is formed from heavy cloth.

6. A laundry bag assembly as recited in claim 1, wherein said bag is formed from cloth.

7. A laundry bag assembly as recited in claim 1, further comprising hanging means located on said head portion of said hanger part for hanging said hamper assembly.

8. A laundry bag assembly as recited in claim 7, wherein said hanging means comprise a loop.

9. A laundry bag assembly as recited in claim 1, wherein said hanger part comprises a plush or soft sculpture.

10. A laundry bag assembly, comprising:

a bag into which articles are insertable having a first side and a second side, said bag having a first arm opening on said first side of said bag, a second arm opening on said second side of said bag, and a neck opening on the upper part of said bag;

a hanger part for suspending said bag and comprising a head portion, a neck portion removably insertable into said neck opening of said bag, and first and second arm portions extending laterally from said neck portion wherein said first and second arm portions are removably insertable into said first and second arm openings of said bag respectively; and cooperating fastening means having a first connecting area and second connecting area for connecting said first arm opening and said neck opening, wherein said cooperating fastening means have a closed position in which said first arm opening is separated from said neck opening and wherein said hanger part is connected to said bag and an open position in which said first arm opening and said neck opening are a contiguous aperture and wherein said hanger part is removed from said bag.

11. A laundry bag assembly as recited in claim 10, further comprising a non-elastic strap having a first and second end, said non-elastic strap surrounding said neck opening of said bag and wherein said first connecting area is situated on said first end of said non-elastic strap and said second connecting area is situated on said second end of said non-elastic strap for attaching said first end of said non-elastic strap to said second end of said non-elastic strap.

12. A laundry bag assembly as recited in claim 10, wherein said connecting means comprise hooks located on said first connecting area and loops located on said second connecting area.

13. A laundry bag assembly as recited in claim 11, wherein said connecting means comprise hooks located on said first connecting area of said first end of said non-elastic strap and loops located on said second connecting area of said second end of said non-elastic strap.

14. A laundry bag assembly as recited in claim 11, wherein said non-elastic strap is formed from heavy cloth.

15. A laundry bag assembly as recited in claim 10, wherein said bag is formed from cloth.

16. A laundry bag assembly as recited in claim 10, further comprising hanging means located on said head portion of said hanger part for hanging said hamper assembly.

17. A laundry bag assembly as recited in claim 16, wherein said hanging means comprise a loop.

18. A laundry bag assembly as recited in claim 10, wherein said hanger part comprises a plush or soft sculpture.

* * * * *